US007020924B2

(12) United States Patent
Cragg

(10) Patent No.: US 7,020,924 B2
(45) Date of Patent: Apr. 4, 2006

(54) STATIC STABILIZERS FOR BRIDGES

(75) Inventor: Robert L. Cragg, Maple Glen, PA (US)

(73) Assignee: Steward Machine Co., Inc., Birmingham, AL (US)

( * ) Notice: Subject to any disclaimer, the term of this patent is extended or adjusted under 35 U.S.C. 154(b) by 0 days.

(21) Appl. No.: 10/812,120

(22) Filed: Mar. 29, 2004

(65) Prior Publication Data

US 2005/0210607 A1 Sep. 29, 2005

(51) Int. Cl.
*E01D 15/06* (2006.01)

(52) U.S. Cl. ..... 14/35; 14/31; 14/36

(58) Field of Classification Search ..... 14/73.5, 14/31–49; 52/167.4, 167.7, 1, 167.8, 393, 52/573.1; 267/136, 140.2–140.4; 248/566, 248/576, 609, 636, 962
See application file for complete search history.

(56) References Cited

U.S. PATENT DOCUMENTS

| | | | | | |
|---|---|---|---|---|---|
| 503,377 | A | * | 8/1893 | Lamont | 14/37 |
| 834,135 | A | * | 10/1906 | Newton | 15/104.33 |
| 978,493 | A | | 12/1910 | Scherzer | 14/41 |
| 1,337,187 | A | | 4/1920 | Andersen | 14/41 |
| 1,542,972 | A | | 6/1925 | Strauss | 14/41 |
| 1,659,250 | A | | 2/1928 | Erdal | 14/41 |
| 2,085,613 | A | | 6/1937 | Stiles | 14/35 |
| 2,109,797 | A | * | 3/1938 | Lubin | 14/36 |
| 3,308,496 | A | * | 3/1967 | Mooney et al. | 14/36 |
| 4,187,573 | A | * | 2/1980 | Fyfe et al. | 14/73.5 |
| 4,599,834 | A | * | 7/1986 | Fujimoto et al. | 52/167.8 |
| 4,706,319 | A | * | 11/1987 | Sivachenko et al. | 14/73 |
| 4,718,648 | A | * | 1/1988 | Taylor | 267/64.13 |
| 4,751,758 | A | * | 6/1988 | Nedelcu | 14/36 |
| 5,014,474 | A | * | 5/1991 | Fyfe et al. | 52/167.8 |
| 5,327,605 | A | | 7/1994 | Cragg | 14/41 |
| 5,466,068 | A | * | 11/1995 | Andra et al. | 384/36 |
| 5,597,240 | A | * | 1/1997 | Fyfe | 384/36 |
| 6,588,041 | B1 | | 7/2003 | Cragg et al. | 14/46 |

* cited by examiner

*Primary Examiner*—Raymond W Addie
(74) *Attorney, Agent, or Firm*—Howson and Howson

(57) ABSTRACT

An adjustable static stabilizer used to ameliorate shock loading. The static stabilizer has a housing forming a chamber and an upwardly-open cylindrical carrier moveably mounted in the chamber. A plurality of spring washers are mounted in the carrier, and a shoe cap extends transverse to the carrier for engaging the spring washers therein. A tie rod interconnects the shoe cap and the carrier for displacement of the shoe cap relative to the housing, and a threaded means is disposed between the housing and the carrier for rotatably mounting the carrier in the housing which is operable upon rotation of the shoe cap relative to the housing to enable the overall height of the stabilizer to be adjusted.

25 Claims, 4 Drawing Sheets

STATIC STABILIZERS FOR BRIDGES

FIELD OF THE INVENTION

The present invention relates generally to bridges, and more particularly, the present invention relates to apparatus for reducing impact loads to movable bascule bridge leafs and associated support structures as the leafs close as well as for maintaining static stability of the leafs when fully closed.

BACKGROUND OF THE INVENTION

Bascule bridges need to possess the ability for the bridge operator to quickly and reliably change span orientation to alternately permit the passage of land and waterway traffic. Bascule bridges must be able to open and close on demand; yet, at the same time they should be as rigid in their closed position as a fixed span. The system intended to secure bridge leafs in the closed position is customarily known as a "Static Stabilizing System" and it normally includes components such as span locks, live load shoes, anchorages, machinery brakes and, in some instances, tail locks. Live load shoes and anchorages are the heart of the system because they transfer the traffic loads directly from the leaf to the pier. Both of these components are frequently subjected to shock loads both when the leaf is closing into its fully seated position and when the leaf is closed with heavy traffic crossing the span. Leaf pounding, or bounce, resulting from vehicle passage and from the leaf slamming down hard onto its seats with each closing, imparts shock loads to the movable leaf structure as well as to the pier and supporting structures. Repetitive shock loading causes abnormal wear of the live load shoes, anchorages and their respective seats.

Over years of bridge service, the excessive wear, coupled with normal thermal expansion and contraction, corrosion and deterioration, diminishes the ability of the components to act in concert with one another and function as a system. Many serious problems result, including distress and failures in machinery components, which are directly attributable to poorly adjusted and maintained static stabilizing components. For example, there is spalling and cracking of live load seat concrete support columns from frequent high shock loads due to slamming the leaf onto its seat during closing plus repetitive shock loads from vehicles passing across the span; fracture of pinion or rack teeth in the operating machinery caused by cyclic shock loads on both faces of a tooth while the leaf is closed; and, fracture of trunnion bearing bushings caused by extremely high loads and repetitive shocks due to poorly adjusted live load shoes, anchorages and span locks.

Frequent periodic bridge maintenance is required to assure that live load shoes are in firm contact with their seats and the anchorages are adjusted as intended. Adjustment usually requires complete removal of each live load shoe and anchorage in order to insert shims of proper thickness between them and their respective supporting structures. When the leaf is closed and the span locks are engaged, the live load shoes should not have any clearance with their seats. Correct anchorage adjustments depend on the particular design of the bascule leaf. Some do not require any clearance with their seats, and others require a slight, e.g. 0.020 to 0.050 inch clearance. Live load shoe and anchorage adjustment is tedious and difficult because the components are cumbersome, weighing hundreds of pounds, and because anchorages are often situated in inaccessible locations with respect to the bascule leaf. Adjustment is a time-consuming, labor-intensive process that requires the span be closed to all vehicular and waterway traffic, and this results in inconveniences to the traveling public. Failure to keep the static stabilizing system properly adjusted is an invitation to more serious trouble and damage, greater repair and replacement costs, and lengthier periods of inconvenience to users of the bascule bridge.

OBJECTS OF THE INVENTION

Accordingly, it is an object of the present invention to provide an improved bascule bridge static stabilizing system which minimizes the shock loads caused by slamming down of the leaf during closing and resulting from the passage of heavy vehicular traffic when the leaf is fully closed.

Another object is to provide apparatus useful with a bascule bridge leaf to assure positive stability and integrity for the leaf in the closed position.

Yet another object is to provide a bascule bridge static stabilization system in which the bascule leaf can be maintained and repaired with a minimum of interruption of bridge service to vehicular and waterway traffic and attendant inconvenience to the traveling public.

Still another object is to provide a bascule bridge leaf static stabilizing system which can be easily adjusted for correct clearance between contacting parts to ensure positive integrity and rigidity throughout the bridge leafs when in their closed position.

A further object of the invention is to provide a unique energy-absorbing assembly for use with a bascule bridge leaf to enable it to be readily adjusted in situ for proper contact between support members and the leaf without causing major disruption of bridge service to vehicular and waterway traffic.

A still further object is to provide for a bridge span, a live load energy-absorber which is easy to install or to remove for replacement or repair, and which can be manufactured and maintained efficiently.

SUMMARY OF THE INVENTION

These and other objects, features and advantages of the invention are accomplished by means of energy-absorbing static stabilizers juxtaposed with a bridge span and its associated supporting structure to cushion shock loading. Each stabilizer includes a stack of Bellville washer springs carried within a housing juxtaposed between a fixed structure and an end portion of the span. The spring stack is preferable vertically adjustable in the housing to enable a span leaf-engageable bearing cap to be adjusted in situ to effect proper clearance when used in association with bascule bridges. An embodiment that does not include the adjustability feature is also disclosed for use with fixed span bridges.

BRIEF DESCRIPTION OF THE DRAWINGS

For a more complete understanding and appreciation of the invention and its many attendant advantages, reference will be made to the following detailed description taken in conjunction with the accompanying drawings, in which.

DESCRIPTION OF THE PREFERRED EMBODIMENTS

Figure 1A:
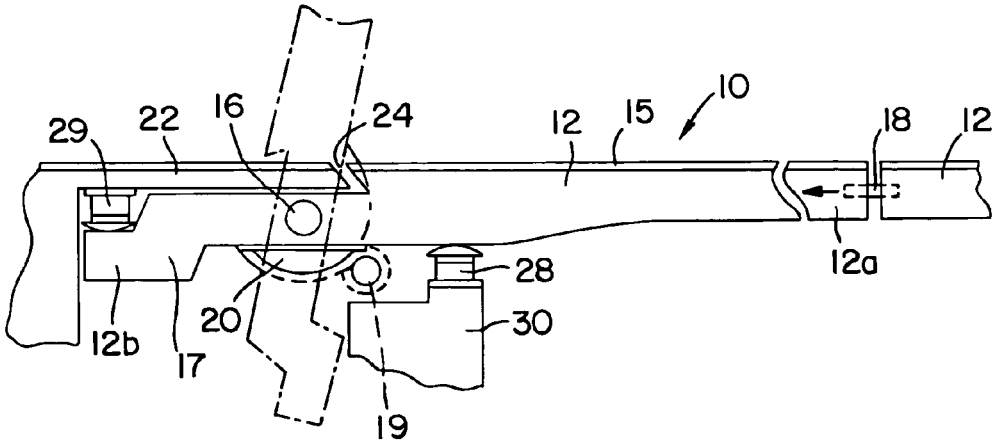
FIGS. 1A, 1B and 1C are schematic representations in elevation of three bascule bride embodiments according to the invention.

Referring now to the drawings, wherein like reference numerals and characters denote like or corresponding parts throughout the several views, FIG. 1A illustrates one embodiment of the invention incorporated in a trunnion bascule bridge 10 having a pair of opposed complementary span sections or leafs 10*a* and 10*b*. Each leaf, such as the leaf 10*a*, pivots about a trunnion 16 supported in a bearing (not shown) mounted on a fixed pier (not shown). The leafs 10*a* and 10*b* are similar in construction and include at least two girders 12 extending the full length of the movable span. Each girder has a forward leaf span portion 12*a* and a reward leaf tail portion 12*b*. A road bed surface 15 for vehicular traffic is supported by the leaf girders 12 on its forward span extension over a waterway below the bridge. A counterweight 17 is attached to rearward leaf tail portions 12*b* of girders 12 so that the movable leaf 10*a* is essentially balanced about a horizontal pivot axis extending through the trunnion 16. A motor driven pinion 18 meshes with a sector gear 20 affixed to girders 12 for rotating the leaf 10*a* from a substantially horizontal, or closed position endwise aligned with companion leaf 10*b* and spanning between opposed approach roadways 22 (shown in full) to an open upwardly-inclined position (shown in phantom). In this embodiment, a road break 24 is located forwardly of the trunnion 16 toward an outer end 12*a* of girder 12. Preferably, an energy absorbing span lock system 18, such as disclosed in U.S. Pat. No. 6,588,041, issued to Steward Machine Co., Inc. the owner of the present application, connects to outer ends of leafs 10*a* and 10*b* when they are aligned with in the bridge in its fully closed position.

According to this preferred embodiment, two energy-absorbing static stabizer assemblies 28 and 29, are provided in juxtaposition with respect to the leaf trunnion 16 to statically secure bridge leaf 10*a* when closed and to absorb shocks while closing. One assembly 28, commonly called a live load shoe, is mounted on a top surface of a fixed concrete pier 30 located below the bridge leaf 10 for releasable contact with a lower surface of girder 12 between trunnion 16 and the forward outer end 12*a* of girder 12. The other assembly 29, commonly called an anchorage, is mounted underneath approach roadway structure 22 for releasable contact with an upper surface of the rearward tail end portion of the girder 12*b* in the vicinity of the counterweight 17.

The energy absorbing assemblies 28 and 29 are adjusted with the leafs 10*a* and 10*b* in their closed positions in relation to one another for cooperatively reducing repetitive, high shock loads to the supporting structures 30 and 22 resulting from constant, heavy vehicular traffic. To this end, as best seen in FIGS. 2–5, each energy absorbing assembly, such as assembly 28, is of like construction to the other, but each may differ in size and resiliency according to design shock loads expected to be encountered. Each assembly, such as the assembly 28, comprises a housing 32 having a cylindrical wall 34 closed at one end by a planar rectangular base 36 that is normal to a central vertical cylindrical axis A—A. The base 36 is adapted to be mounted by conventional means, such as lag bolts, (not shown) on either pier 30 or under approach roadway structure 22. The housing 32 is enclosed at the end opposite the base 36 by a rectangular cap shoe 38 having a circular flange 40 depending into cylindrical wall 34 on vertical axis A—A. A protective skirt 41 depends from the cap periphery to encircle an annular gap 43 between the telescopically overlapping surfaces of housing wall 34 and cap shoe 38 for preventing foreign matter from entering the assembly 28. An arcuate load bearing surface 38*a* is provided on the cap to engage girders 12 along a single line of contact L—L as well known in the art.

Figure 4:
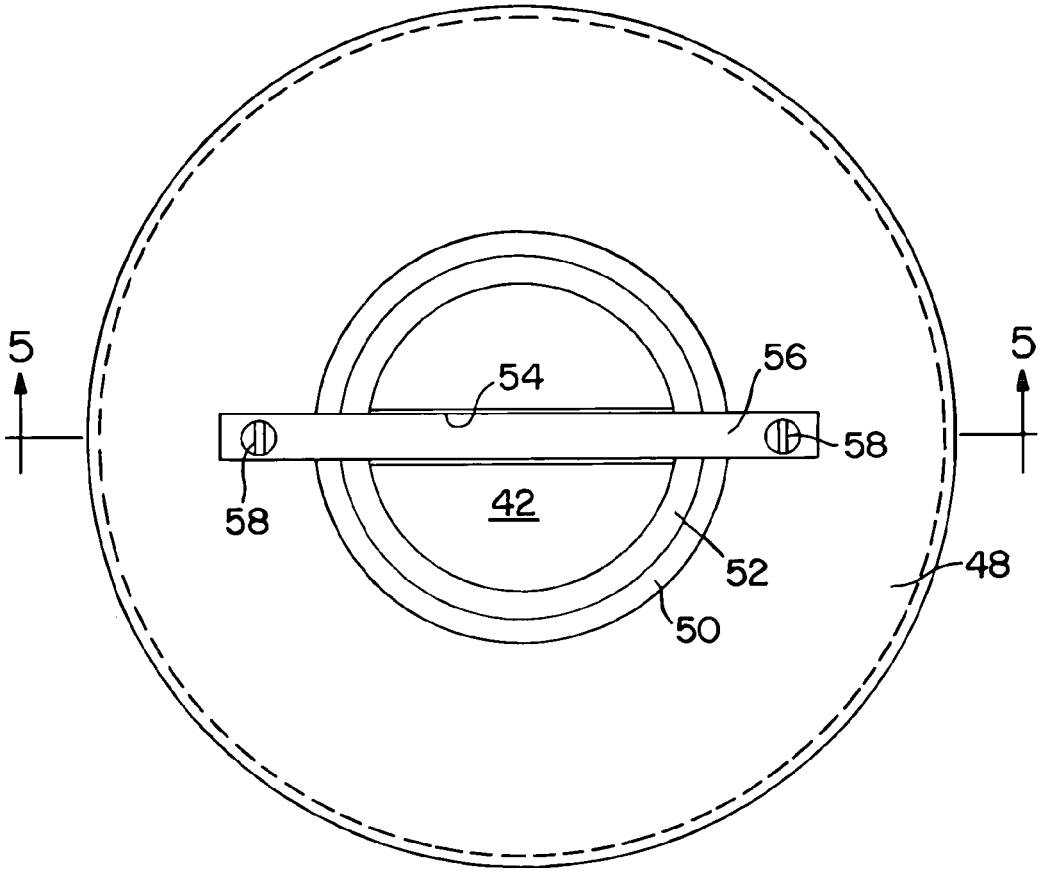
FIG. 4 is a view of a portion of the assembly of FIG. 2 taken in a transverse plane on Line 4—4 of FIG. 3.
Figure 5:
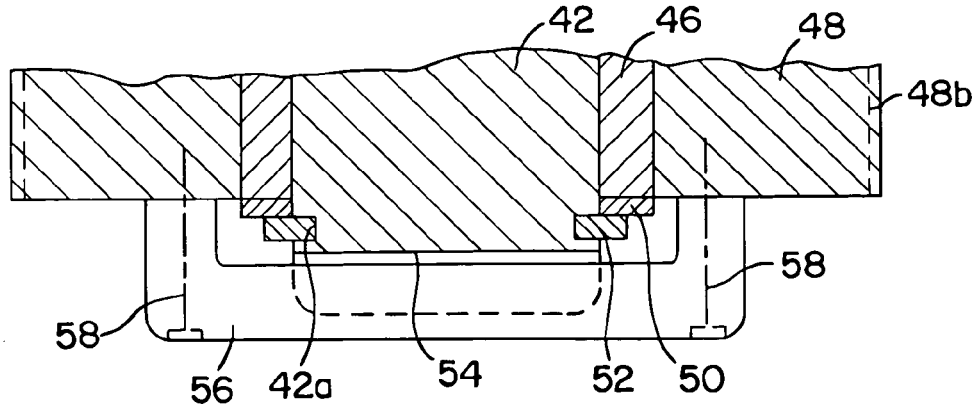
FIG. 5 is a view in cross section of the portion of the assembly of FIG. 2 taken in a plane on Line 5—5 of FIG. 4.

The cap shoe 38 is adjustable relative to the base 36. To this end, a cup-shaped spring carriage 48 is mounted inside the cylindrical housing wall 34 for vertical adjustment relative thereto. The inner surface of spring carrier 48 is contiguous with a bushing 46, and the outer surface has threads 48*b* which threadedly engage threads 34*b* on the inner surface of the housing cylindrical wall 34. The threads 34*b* extend upwardly from an annular bottom shoulder 36*a* in base 36. A cylindrical guide pin 42 is welded at W around its upper end to the underside of cap shoe 38. The guide pin depends into carrier 47 through a stack of Bellville spring washers 44 coaxially confined between two spaced apart flat washers 45, a shoulder 48*a* of the annular spring carrier 48, and a guide bushing 46. The lower end portion of guide pin 42 depends into a recess 36*b* circumscribed by shoulder 36*a* for mounting a washer 50 and a retainer ring 52 in an annular groove 42*a* to secure Bellville spring washers 44 axially between the cap shoe 38 and the adjustable spring carrier 48. As best seen in FIG. 4, guide pin 42 terminates in a diametrical slot 54 for receiving with an axial clearance a diametrical elongate yoke 56 which is connected at opposite ends to carrier 48 by bolts 58 to assure correct orientation of arcuate surface 38*a* with aligning slots 64 in spring carrier 48.

The stabilizer assembly 28 is lubricated prior to being placed in service, and can be lubricated while in service. For this purpose, at least one grease cap 38 (FIG. 3) is mounted on housing wall 34 for communicating via one or more passages 31*a* through spring carrier 48 to enable additional heavy duty lubricants to be pumped into the housing periodically. A plurality of grease cups 31 and related passages may be provided at various locations in the periphery of the housing wall 34 to afford handy access for lubrication after installation. Any excess lubricant can overflow through the gap 43 between the cap shoe and housing wall.

The stabilizer assemblies are adjusted in situ while bridge leafs 10*a* and 10*b* are in the closed position with no vehicular traffic passing across the leafs. To this end, sockets 60 are provided in opposite sides of each shoe 38 approximately aligned with the line of contact L—L. An elongate bar (not shown) is inserted into a sockets for rotating the cap shoe 38 and spring carrier 48 in housing 34 until a desired clearance, as required by the particular application, is obtained with the leaf girder 12. As the cap shoe 38 rotates, threads 34*b* and 48*b* slowly displace the spring carrier 48 relative to housing 32. The spring carrier 48 is locked in selected 180° rotational increments by means of at least one, but preferably a pair of, alignment screws 62 threaded into housing wall 34 and laterally engageable in diametrically opposed vertical slots 64 in carrier 48. Each 180° increment of rotation of shoe 38 displaces spring carrier 48 upwardly or downwardly an amount equal to one half of the thread pitch. A preferred thread pitch is fourteen (14) threads per inch. With no external loads present on cap shoe 38, the Bellville washers are in a relaxed condition, but under either vehicular traffic loading, or slamming of the leafs upon closing, the Bellville spring washers 44 compress to absorb the shock loads.

By way of example, and not by way of limitation, one version of a static stabilizer designed to accommodate a maximum vertical load of about 132,000 pounds has an overall volumetric dimension of about one cubic foot. The maximum vertical travel of the cap shoe is limited to less than about 0.100 inch. For a maximum live load of 132,000 pounds, five Bellville springs are used in series each carrying a maximum live load component of about 26,400 pounds. Thus, the overall spring rate is in excess of about 1,000,000 pounds/inch of deflection. The pitch of the spring carrier threads is such as to provide a total height adjustment on the order of about ½ inch in about 1/32 inch increments for each 180° turn for each of the cap shoe about its vertical axis. In the event that a lower live load is anticipated, one or more spring washers could be replaced with one or more flat washers of the same thickness. As a result, the stabilizer design is able to be readily configured for a variety of design loads with minimal changes in either external or internal structure. This facilitates efficient manufacture and assembly. In addition, the static stabilizers can be mounted cap side up as illustrated at 28 in FIG. 1A or cap side down as illustrated at 29. Preferably, the static stabilizers are mounted to stationary bridge structures as illustrated, but there may be applications in which mounting on moveable bridge components might be indicated.

Figure 1B:
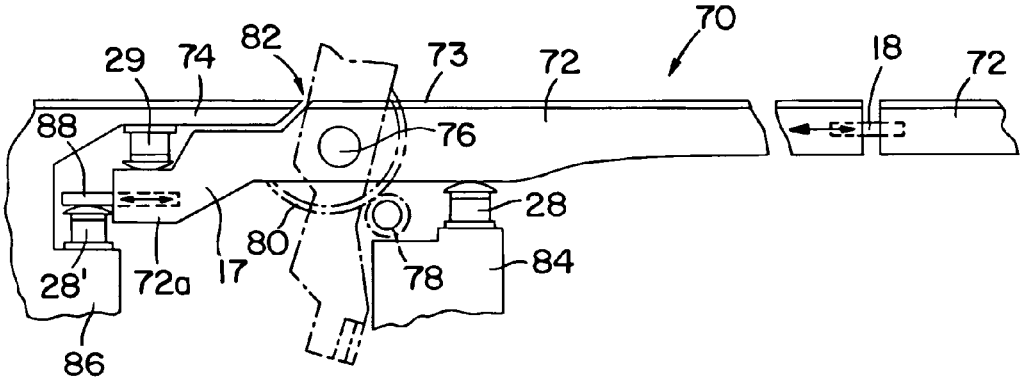

FIG. 1B illustrates another embodiment of a trunnion bascule bridge 70 having opposed leaf span girders 72 of like construction shown in solid lines locked in a fully closed position. Each leaf supports a road bed 73 spanning opposite approach roadway structures, such as roadway 74. A span lock system 18, as described supra, is shown in phantom connecting the leaf spans when in their fully closed positions. Each leaf span girder 72 includes a trunnion 76, carried in a support bearing mounted on a fixed pier (not shown). Each leaf girder 72 is pivoted from a closed position to an open position by a motor driven pinion 78 meshing with a sector gear 80 fixed to each girder 72. A road break 82 is provided between roadbed 73 and approach roadway structure 74 along the width of leaf girders 72 between trunnion 76 and the rearward leaf tail portion 72*a* extension of girder 72.

Figure 1C:
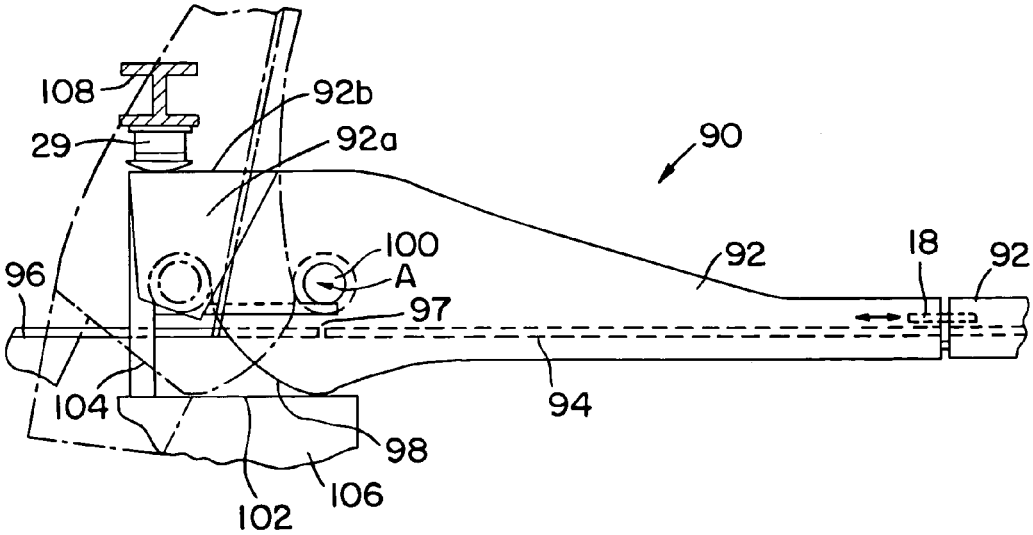
Figure 2:
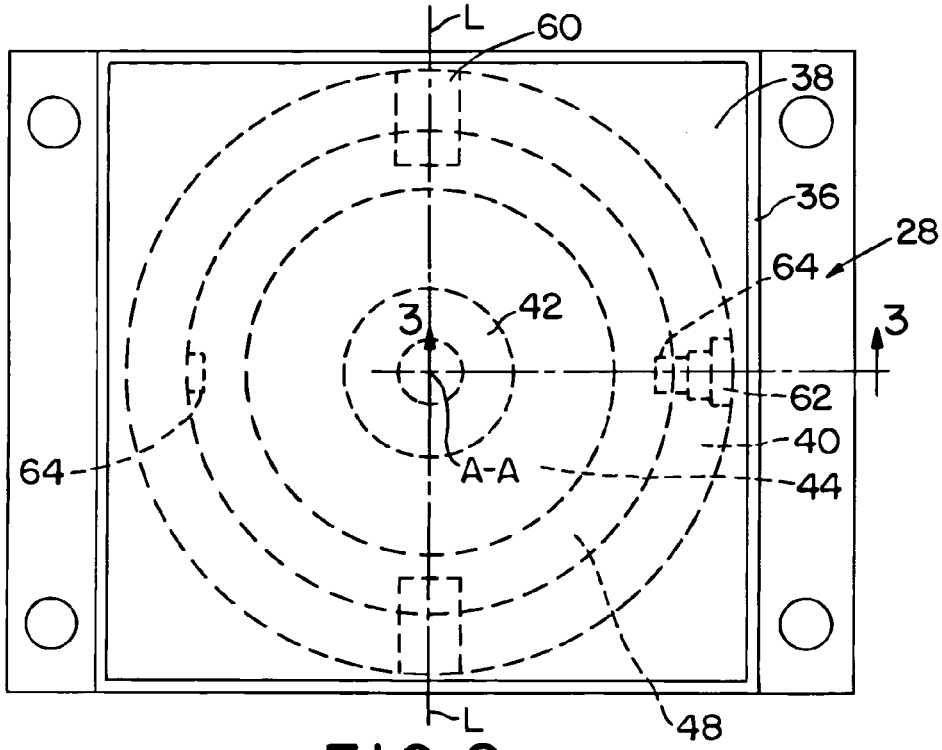
FIG. 2 is a plan view of an adjustable energy absorbing stabilizer assembly for use in effecting static stabilization of the bascule bridge embodiments of FIGS. 1A, 1B and 1C.
Figure 3:
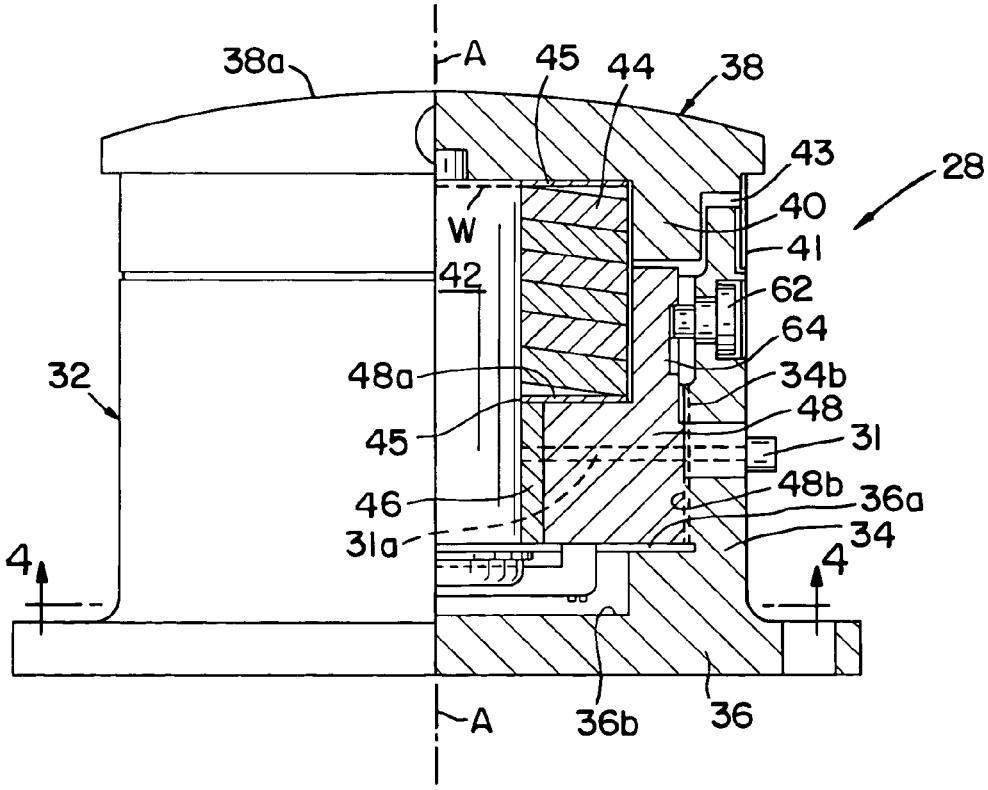
FIG. 3 is a view in cross section of the assembly of FIG. 2 taken in a radial plane on Line 3—3 of FIG. 2.

In this embodiment, two energy absorbing assemblies, such as assembly 28, described above, are installed at predetermined locations along the length of leaf girder 72 at locations similar to those described in FIG. 1. One assembly 28, a live load shoe, is mounted by its base 36 on a fixed concrete support 84 and contacts a lower surface of leaf 72; the second assembly 29, an anchorage, is mounted by its base 36 to a lower surface of the support structure for approach roadway 74 to engage an upper surface of leaf tail end portion 72*a*; and a third assembly 28', another live load shoe, is mounted by its base 36 on a fixed concrete support 86 for engaging a lower surface of a retractable tail lock 88 of conventional construction. Each cushion shoe assembly 28 and 29 is adjusted as described above, and as required by the design, with the span in the closed position and the tail lock 88 disposed in its full line position in FIG. 1B to statically stabilize the span against shock loads as described above.

In a further embodiment illustrated in FIG. 2C, a rolling lift bascule bridge 90 having opposed leafs of similar construction is shown in solid lines in a fully closed position supporting a road bed 94 and is shown in phantom lines in the open position. The leafs are locked in the closed position by a span lock system 18, discussed, supra, with road breaks 97 located between road bed 94 and approach roadway structure 96. The tail end 92*a* of each girder 92 has an arcuate sector 98 of constant radius measured from a horizontal axis of rotation A near an inner, or tail, end 92*a* thereof. A motor-driven pinion 100 fixed to leaf 92 at axis A causes sector 98 to roll on an elongate horizontal bearing plate 102 mounted on a concrete pier 106.

One energy-absorber cushion shoe assembly 29, as described above, is disposed between a tail end portion 92*a* of each girder 92 and a static structure adjacent the roadway approach to provide a desired tail-end static stabilization of the bridge leaf. To this end, assembly 29, an anchorage, is mounted below a fixed structure 108 above leaf tail end portion 92*a* for engaging an upper surface portion 92*b* thereof. As described above, the assembly 29 is adjusted in situ to insure firm contact of its cap shoe with girder tail end portion 92*a*.

Figure 6:
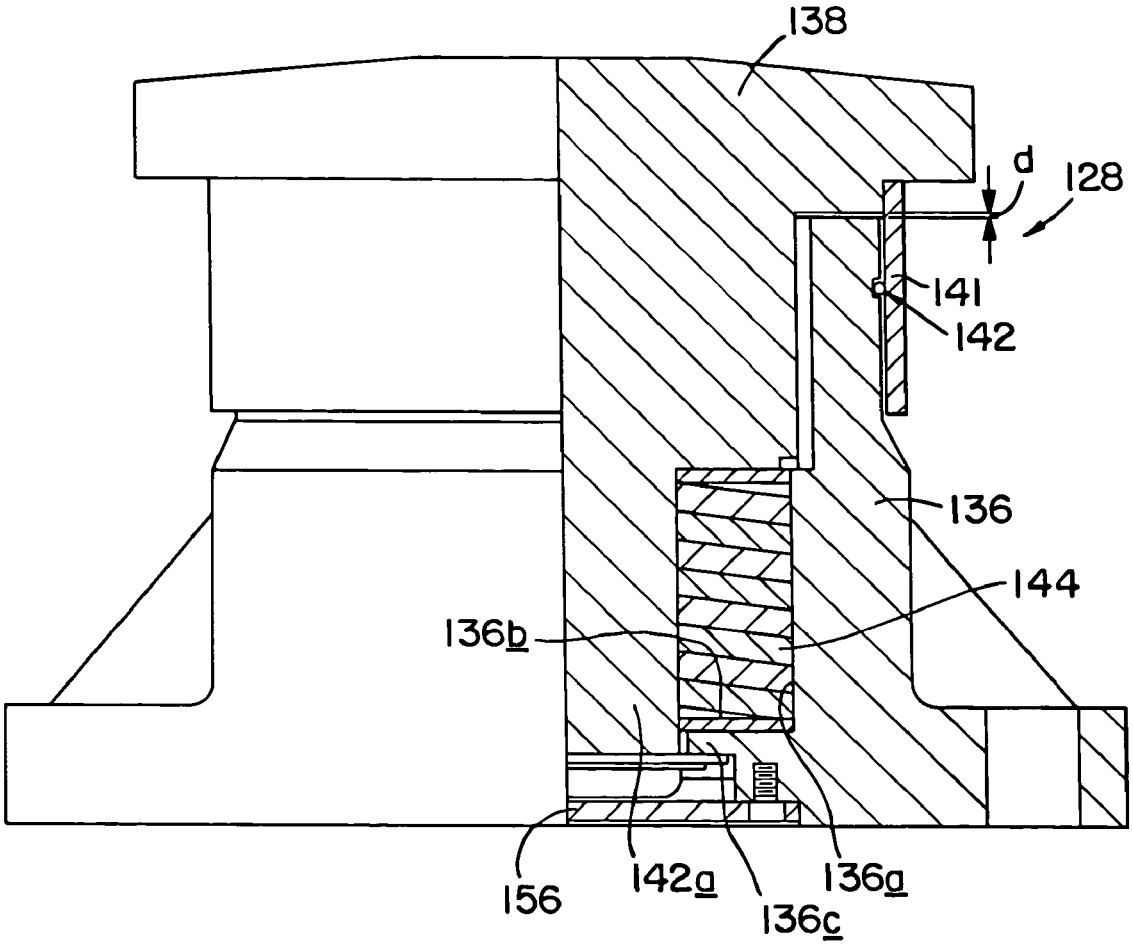
FIG. 6 is a view in vertical cross-section of another embodiment which does not include in situ adjustability features.

In the preceding embodiments, adjustable static stabilizers are disclosed for use in association with various types of bascule bridges that require periodic adjustment due to the inherent nature of their moveable components. For fixed span bridges that may not require periodic adjustment, but which are subject to shock loading due to heavy-fast moving traffic, another embodiment is provided. As best seen in FIG. 6, the static stabilizer 128 illustrated is similar in many respects to the static stabilizer 28 in that it has a similar moveable cap shoe 138, a somewhat similar housing 136, and a stack of Bellville spring washers 144. In this embodiment however, the spring washer stack 144 is not vertically adjustable in the housing 136. Rather, the stack is are confined in a cylindrical chamber 136*a* between a housing bottom wall 136*b* and the underside of the shoe cap boss 142. The shoe cap 138 is connected to the housing 136 in a manner similar to the stabilizer 28, having a connecting rod portion 142*a* depending from the shoe cap boss and fastened in a similar manner at its lower end to a circular 136*c* flange adjacent to the base of the housing 136. A closure plate 156 is slotted (not shown) for cooperating with a tang (not shown) on the bottom of the connecting rod portion 142*a* to anti-rotatively connect the shoe cap to the housing 136. An O-ring 142 cooperates with a descending peripheral skirt 141 to protect the interior of the stabilizer from the ingress of foreign matter. Downward displacement of the shoe cap 138 compresses the spring washers in the stack 144 to absorb shock loads such as in the manner described heretofore. In this embodiment, the displacement is less than about 0.100 inches as indicated by the dimension d in FIG. 6. By way of example and not by way of limitation, in this embodiment, for a dead load design of 100,000 lbs., and a 212,000 lbs. load to full deflection "d", eight (8) Bellville spring washers are contained in a housing having an overall height of about 16 inches and a base 24 inches square.

In view of the foregoing, it should be apparent that the disclosed embodiments provide statically stabilized bridges in which shock loads are reduced. As a result, damage to the piers and supporting structures, and consequent costly repairs and replacements are greatly reduced. In addition, when used on bascule bridges the static stabilizing systems are easy to adjust with a minimum of bridge downtime and cost and a minimum of interruption of service to both vehicular and waterway traffic.

Various modifications, alterations and changes may be made without departing from the spirit and scope of the invention as defined in the appended claims.

The invention claimed is:

1. A statically-stabilized bascule bridge having a leaf with a span portion adapted to extend in a forward direction from a trunnion pivot over a waterway in a bridge closed position and a tail portion extending in a rearward direction from the trunnion pivot to extend under a roadway approach structure, said bridge including a static stabilizer comprising:

a housing for mounting in juxtaposition between said leaf tail portion and said roadway approach structure when said bridge is in its closed position;

a shock absorbing assembly carried in said housing;

a shoe cap extending transversely of said housing for engaging said shock absorbing assembly to effect resilient displacement thereof when said shoe cap is urged toward said housing by said leaf tail portion;

means carried in said housing for setting a predetermined operating clearance between said shoe cap and said leaf tail portion said means including matingly engaged threads between said housing and said shock absorbing assembly cooperable upon rotation of said shock absorbing assembly to effect shoe cap displacement; and at least one locking pin carried by said housing for releasably laterally engaging said shock absorbing assembly to secure said shoe cap in a selected adjusted position.

2. The bascule bridge according to claim 1, wherein said shoe cap is fixedly connected to said shock absorbing assembly and includes surface structure cooperable with an elongate bar for effecting said shock absorbing assembly rotation relative to said housing.

3. The bascule bridge according to claim 1, wherein said shock absorbing assembly includes a shock absorber carrier having threads providing said threaded engagement with said housing and having at least one elongate slot for operably receiving said locking pin to preclude rotation of said shoe cap after said selected adjusted position has been effected.

4. A statically-stabilized bascule bridge according to claim 1, wherein said bridge includes a retractable tail lock, and another static stabilizer of like construction to said first-mentioned static stabilizer for releasably engaging said tail lock when in its extended locking position when said leaf is in its bridge closed position.

5. A statically-stabilized bascule bridge having a leaf with a span portion adapted to extend in a forward direction from a trunnion pivot over a waterway in a bridge closed position and a tail portion extending in a rearward direction from the trunnion pivot to extend under a roadway approach structure, said bridge including a static stabilizer comprising:

a housing for mounting in juxtaposition between said leaf tail portion and said roadway approach structure when said bridge is in its closed position;

a shock absorbing assembly carried in said housing; and a shoe cap extending transversely of said housing and engaging said shock absorbing assembly to effect resilient displacement thereof when said shoe cap is urged toward said housing by said leaf tail portion;

said shock absorbing assembly including a carrier contained in said housing, an elastic energy absorber assembly contained in said carrier, and a tie rod connecting said carrier to said shoe cap while enabling said carrier to be displaced relative to said housing for effecting clearance adjustments between said shoe cap and its juxtaposed bridge structure.

6. The bascule bridge according to claim 5 wherein said elastic energy absorbing assembly includes a stack of Bellville washers with said tie rod extending centrally through said stack, and including means connecting said tie rod at one end to said shoe cap and means connecting said tie rod at its other end to said carrier.

7. The bascule bridge according to claim 5 including another static stabilizer of like construction to said first-mentioned static stabilizer for releasably engaging said leaf span portion forward of said trunnion pivot when said leaf is in said bridge closed position.

8. A static stabilizer for use with a bridge span structure to ameliorate shock loading on adjacent bridge span supporting structure, comprising:

a housing having a base and a wall extending upwardly from the base to form a chamber;

a plurality of spring washers mounted in said chamber;

a shoe cap extending across said housing for engaging said spring washers therein;

a tie rod interconnecting said shoe cap and said housing below said spring washers;

an upwardly-open cylindrical carrier moveably mounted in said housing chamber for containing said spring washers therein; and threaded means disposed between said housing wall and said carrier for rotatably mounting said carrier in said housing and operable upon rotation of said shoe cap relative to said housing base to enable the overall height of the stabilizer to be adjusted;

whereby downward displacement of the shoe cap compresses the spring washers therein.

9. The static stabilizer according to claim 8 including a fixed span bridge having an end portion overlying a bridge pier and wherein said static stabilizer is juxtaposed between said end portion and said pier.

10. The static stabilizer according to claim 8 including a bascule bridge leaf having a forward portion extending over a support pier and having a rearward portion extending underneath an approach roadway structure, wherein said static stabilizer is juxtaposed with at least one of said leaf portions.

11. The static stabilizer according to claim 10 wherein said bascule bridge has a retractable tail lock in its rearward leaf portion, and wherein said static stabilizer is juxtaposed with said leaf portion to engage said tail lock when in its extended position.

12. The static stabilizer according to claim 8, wherein said housing wall mounts at least one locking pin moveable laterally toward and away from said carrier, and said carrier has an elongate slot confronting said locking pin for receiving said locking pin and precluding rotation of said carrier relative to said housing when said shoe cap is in a selected height-adjusted position.

13. The static stabilizer according to claim 12 when said shoe cap has an arcuate bearing surface providing a line contact portion, and said locking pin located in said housing wall locks said shoe cap only in preselected positions relative to said base.

14. The static stabilizer according to claim 12 wherein said shoe cap has a downwardly opening recess juxtaposed with said carrier opening to provide a chamber for receiving said spring washers, and said shoe cap has an outwardly-extending peripheral flange overlying a peripheral end of said housing wall with a gap therebetween, and including a skirt depending from said shoe cap peripheral flange across said gap for limiting ingress of foreign matter into said housing.

15. The static stabilizer according to claim 12 wherein said shoe cap has an outer periphery and including means on said periphery for releasably receiving an elongate bar for rotating said cap relative to said housing and thereby effecting said height adjustment of said static stabilizer.

16. The static stabilizer according to claim 12 wherein said shoe cap has a depending boss engaging said spring washers and a tie rod portion depending through the spring washers and connected to the housing therebelow.

17. A static stabilizer used to ameliorate shock loading, comprising:

a housing having a base and a wall extending upwardly from the base to form a chamber;

an upwardly-open cylindrical carrier moveably mounted in said housing chamber;

a plurality of spring washers mounted in said cylindrical carrier;

a shoe cap extending transverse to said carrier for engaging said spring washers therein;

a tie rod interconnecting said shoe cap and said carrier for displacement of said shoe cap relative to said housing; and threaded means disposed between said housing wall and said carrier for rotatably mounting said carrier in said housing and operable upon rotation of said shoe cap relative to said housing base to enable the overall height of the stabilizer to be adjusted;

whereby downward displacement of the shoe cap compresses the spring washers therein.

18. The static stabilizer according to claim 17, wherein said housing wall mounts at least one locking pin moveable laterally toward and away from said carrier, and said carrier has an elongate slot confronting said locking pin for receiving said locking pin and precluding rotation of said carrier relative to said housing when said shoe cap is in a selected height-adjusted position.

19. The static stabilizer according to claim 18, when said shoe cap has an arcuate bearing surface providing a line contact portion, and said locking pin located in said housing wall locks said shoe cap only in preselected positions relative to said base.

20. The static stabilizer according to claim 17, wherein said shoe cap has a downwardly opening recess juxtaposed with said carrier opening to provide a chamber for receiving said spring washers, and said shoe cap has an outwardly-extending peripheral flange overlying a peripheral end of said housing wall with a gap therebetween, and including a skirt depending from said shoe cap peripheral flange across said gap for limiting ingress of foreign matter into said housing.

21. The static stabilizer according to claim 17, wherein said shoe cap has an outer periphery and including means on said periphery for releasably receiving an elongate bar for rotating said cap relative to said housing and thereby effecting said height adjustment of said static stabilizer.

22. The static stabilizer according to claim 17, wherein said shoe cap has a depending boss engaging said spring washers and a tie rod portion depending through the spring washers and connected to the housing therebelow.

23. The static stabilizer according to claim 17, including a fixed span bridge having an end portion overlying a bridge pier and wherein said shoe cap is juxtaposed between said end portion and said pier.

24. The static stabilizer according to claim 17, including a bascule bridge leaf having a forward portion extending over a support pier and having a rearward portion extending underneath an approach roadway structure, and wherein said shoe cap is juxtaposed with at least one of said leaf portions.

25. The static stabilizer according to claim 24, wherein said bascule bridge has a retractable tail lock in its rearward leaf portion, and wherein said shoe cap is juxtaposed with said leaf portion to engage said tail lock when in its extended position.

* * * * *